US006117199A

United States Patent [19]

Ruottu

[11] Patent Number: 6,117,199

[45] Date of Patent: Sep. 12, 2000

[54] METHOD AND APPARATUS FOR GASIFYING SOLID CARBONACEOUS MATERIAL

[75] Inventor: Seppo K. Ruottu, Karhula, Finland

[73] Assignee: Foster Wheeler Energia Oy, Helsinki, Finland

[21] Appl. No.: 08/115,791

[22] Filed: Sep. 3, 1993

Related U.S. Application Data

[63] Continuation of application No. 06/371,796, Apr. 26, 1982, abandoned, which is a continuation of application No. 06/640,526, Aug. 14, 1984, abandoned, which is a continuation of application No. 07/536,931, Jun. 12, 1990, abandoned, which is a continuation of application No. 07/844,915, Mar. 5, 1992, abandoned.

[51] Int. Cl.[7] ..... C10J 3/16

[52] U.S. Cl. ..... 48/197 R; 48/206

[58] Field of Search ..... 48/197 R, 206, 48/209

[56] References Cited

U.S. PATENT DOCUMENTS

| | | | |
|---|---|---|---|
| 3,840,353 | 10/1974 | Squires | 48/203 |
| 3,867,110 | 2/1975 | Schor et al. | 48/206 |
| 3,957,457 | 5/1976 | Squires . | |
| 3,957,458 | 5/1976 | Squires . | |
| 3,971,637 | 7/1976 | Matthews | 48/206 |
| 4,017,272 | 4/1977 | Anwer et al. | 48/192 R |
| 4,032,305 | 6/1977 | Squires . | |
| 4,057,402 | 11/1977 | Patel et al. | 48/206 |
| 4,073,642 | 2/1978 | Collin et al. | 75/35 |
| 4,099,933 | 7/1978 | Johnson | 48/202 |
| 4,154,581 | 5/1979 | Nack et al. | 48/197 R |
| 4,315,758 | 2/1982 | Patel et al. | 48/206 |
| 4,347,064 | 8/1982 | Reh et al. | 48/197 R |
| 4,444,568 | 4/1984 | Beisswenger | 48/197 R |

FOREIGN PATENT DOCUMENTS 1528623 10/1978 United Kingdom .

OTHER PUBLICATIONS

Squiries, "Gasification of Coal in High–Velocity Fluidized Beds", Future Energy Production Systems, Hemisphere Publishing Corporation, Washington, D.C., 1976, vol. 2, pp. 509–522.

Squires, "Chemicals from Coal", *Science*, Feb. 20, 1976, vol. 191, pp. 689–700.

*Primary Examiner*—Robert J. Warden, Sr.
*Attorney, Agent, or Firm*—Nixon & Vanderhye P.C.

[57] ABSTRACT

Method and apparatus for gasifying of a solid carbonaceous material in a fluidized bed reactor in which the solid particles entrained by the gases being removed from the upper part of the reactor are separated and returned to the lower part of the reactor. oxygenous gas is supplied into the lower part of the reactor and the non-reacted carbonaceous material separated from the gases is oxidized in the lower part of the reactor. The carbonaceous material is introduced above the oxidizing zone into a zone substantially free of oxygen and the carbonaceous material is pyrolyzed and reduced by means of the hot gases and particles rising from the lower part of the reactor.

13 Claims, 1 Drawing Sheet

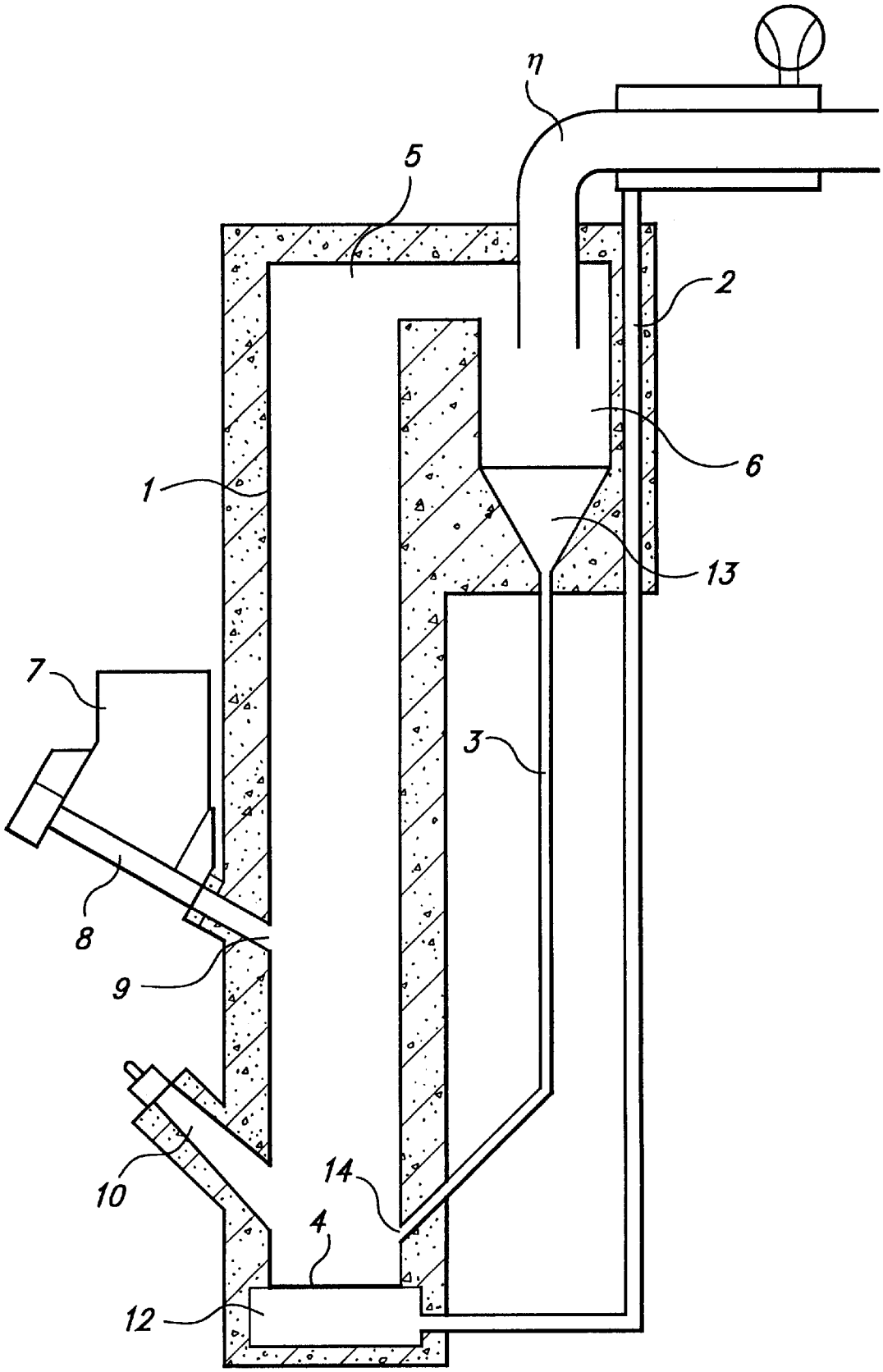
η
5
2
6
1
13
7
3
8
9
10
14
4
12

METHOD AND APPARATUS FOR GASIFYING SOLID CARBONACEOUS MATERIAL

This is a continuation of application Ser. No. 06/371,796 filed Apr. 26, 1982 now abandoned. This is a continuation of application Ser. No. 06/640,526, filed Aug. 14, 1984, now abandoned. This is a continuation of application Ser. No. 07/536,931, filed Jun. 12, 1990, now abandoned. This is a continuation of application Ser. No. 07/844,915, filed Mar. 5, 1992, now abandoned.

The present invention is related to a method and an apparatus for gasifying solid carbonaceous material in a fluidized bed reactor in which the solid particles entrained by the gases being discharged from the upper part of the reactor are separated and returned to the lower part of the reactor.

It is an object of the present invention to provide a method and an apparatus for gasifying solid carbonaceous material in such a manner that the free oxygen of the oxygen-containing gas is used in the gasifier primarily for oxidizing gasification of the solid particles formed as a result of the pyrolysis.

The essential dilemma in gasifying solid materials is the reduction of $CO_2$ and $H_2O$ produced in the oxidizing phase by means of solid carbon through kinetically slow reactions $CO_2+C_{(D)}\rightarrow 2CO$ and $H_2O+C\rightarrow CO+H_2$. The earliest gasifier types were so called counter-current gasifiers, in which the material to be gasified was fed from above a layer of solid gasification material and the oxidant from below said layer. In these so called stationary bed gasifiers the material moved downwards and was first pyrolyzed at a low temperature in a reducing atmosphere. The temperature of the lower zone is about 1000° C. and there is a lot of reducing carbon surface/volume, whereby an efficient reduction of the: gas phase is achieved in it. Known disadvantages of these gasifier types are the tar compounds of the product gas as well as the entrainment of small particles by the product gases.

In a parallel-flow gasifier both the material to be gasified and the oxidant are brought to the forepart of the reactor, whereby a considerable amount of the pyrolysis gases is oxidized into $CO_2$ and $H_2O$. The remaining solid carbon has to be gasified in these reactors through the above presented slow reducing reactions. Therefore considerable $CO_2$ and $H_2O$ contents of the product gas or considerable carbon losses are the typical problems of the conventional. parallel-flow gasifiers.

In two-zone gasifiers the disadvantages of the above mentioned gasifier types are avoided by dividing the gasification into two separate reactors so that the material to be gasified is first pyrolyzed. The solid material remaining after the pyrolyzation is gasified in a separate reactor, the flue gases of which are brought into the pyrolyzation reactor. Thus the gasification takes place in two downstream connected reactors. Problems of the flow techniques and big investment costs are the disadvantages of the two-zone gasifiers.

The U.S. Pat. No. 4,154,581 discloses a two-zone gasification process which takes place in a fluidized bed reactor. Here the fluidized bed is divided into two zones by means of an intermediate baffling means and the temperature of the lower zone is held suitable for combustion or gasification and the temperature of the upper zone is adjusted in a manner most suitable for the absorption of sulfur. The fuel or the material to be gasified is introduced into the lower zone of the reactor where there is some free oxygen. Then pyrolyzing hydrocarbons are primarily oxidized and form $CO_2$ and $H_2O$, whereby a lot of residual carbon is formed which has to be gasified by means of the combustion products of the hydrocarbons.

The present invention relates to a solution in which the operation explained above in connection with two-reactor gasifiers is achieved in one reactor in the following way: The inlet of the material to be gasified is raised above the air nozzles (3 to 6 m) to an area where the content of free oxygen is small. Thereby the pyrolysis gases formed adjacent to the inlet are not oxidized, but break down thermally into short-chained hydrocarbons, which further react with the $CO_2$ and $H_2O$ which rise from the lower part of the reactor. These so called reducing reactions occur in the upper part of the gasifying reactor, where the dwelling time of the gas (2 to 20 s) and the temperature ($\geqq 900°$) are chosen so that the product gases will end up near a thermodynamic equilibrium. The energy required by the reducing reactions is obtained from the reactions taking place in the lower part of the reactor, mostly oxidizing reactions of carbon. In order to avoid too high temperatures, the differences in temperature between the,reducing and oxidizing zones of the reactor are adjusted by circulating carbon and chemically inert material, such as sand, through both reactors. As the oxidizing and reducing zones are disposed in the same reactor, the circulation can be easily-performed by choosing the particle size and amount of the inert material so that a suitable portion of the material is in pneumatic transfer in the used gas flow rate area. Thereby the solid material separated in the gas purifier and returned to the lower part of the redactor passes first through a hot oxidizing zone and is cooled thereafter when passing through the reducing zone. The mass flow rate of the inert circulation is controlled by controlling the amount of the circulation material so that depending on the sintering temperature of the ashes of the material to be gasified the highest temperature in the oxidizing zone is 970° to 1200° C. and after the reducing zone 70 to 120° C. lower.

In order to keep the temperature differences between the oxidizing and reducing zone within the above mentioned limits, the circulating material has to be circulated so that there is 500 to 1000 g/mol solid material in the gas of the reactor. Thus a big mass flow of fine sand ($10\ \mu m<dp<400\ \mu m$) and inert coal has to be returned from the separator to the lower part of the reactor.

The invention will be described in more detail in the following with reference to the accompanying drawing which is a schematical cross-sectional elevation of an apparatus applying the method according to the invention.

In FIG. 1, reference number 1 refers to a gasifying reactor operating according to the fluidized bed principle, 2 to a cyclone separator in which the solid matter is separated in a manner known per se from the gases being discharged in the upper part of the reactor and 3 to a return pipe for solid matter. In the lower part of the reactor there is a distribution plate 4 through which oxygen-containing gas, such as air, is supplied to the lower part of the reactor. In the upper part of the reactor there is a gas discharge opening 5 through which the gases are conveyed tangentially to the cyclone chamber 6 of the separator 2. The material to be gasified is lifted to a feed bin 7 from which it is fed to the reactor by means of a screw feeder 8 and through a feeding opening 9. For starting, the reactor is provided with a start burner 10.

An axial gas discharge pipe 11 is disposed in the cyclone chamber of the separator, through which pipe gases from which solid particles have been separated, are removed upwards from the chamber. The heat contained in the gases is used for preheating the air fed to the reactor and the preheated gas is led to an air chamber 12 below the distribution plate.

Solid particles fall down to the funnel-shaped lower part of the separator from where they by means of the pipe 3 are returned through an opening 14 to the lower part of the reactor.

The location of the inlet of the material to be gasified is chosen so that it is positioned above the distribution plate at such a height where considerable amounts of oxygen are not present.

EXAMPLE

Peat was gasified to a gasifying reactor, the diameter of which was 600 mm, height measured from the distribution plate to the gas discharge opening 11 mm and the height of the inlet 4 m measured from the distribution plate, under the following circumstances.

| | |
|---|---|
| Dry peat flow | 100 g/s |
| Water flow | 25 g/s |
| Air flow | 210 g/s |
| Maximum temperature of the oxidizing zone | 990° C. |
| Temperature after the separator | 890° C. |

The composition of the gas after the cyclone was:

| Compound | Mole fraction |
|---|---|
| CO | 0,245 |
| $CO_2$ | 0,051 |
| $H_2O$ | 0,092 |
| $CH_4$ | 0,018 |
| $H_2$ | 0,163 |
| $N_2$ | 0,412 |
| $H_2S$ | 0,0004 |

Mole flow of the gas 14.2 mol/s

Circulation material flow 7.8 kg/s (sand)

We claim:

1. A method of gasifying carbonaceous material in a single fluidized bed reactor having:

a lower part defining an oxidation zone, and including a distribution plate;

and an upper part defining a reducing zone and including a gas discharge opening;

said method comprising the steps of substantially continuously:

(a) introducing oxygen containing gas into the lower part of the reactor through the distribution plate;

(b) introducing carbonaceous material to be gasified into the reducing zone in the upper part of the reactor at a point substantially free of oxygen, so that the carbonaceous material is pyrolyzed to produce gases which flow through the gas discharge opening;

(c) separating unreacted carbonaceous material from the gas flowing through the gas discharge opening;

(d) returning the separated unreacted carbonaceous material from step (c) to the oxidation zone below the point of introduction of the carbonaceous material in step (b) so that the unreacted carbonaceous material reacts with oxygen introduced in step (a) to generate heat, $CO_2$ and $H_2O$ and to maintain a temperature of between 970–1200 degrees C in the oxidizing zone;

(e) circulating a sufficient volume of inert particulate material, entrained in gas within the reactor so as to carry sufficient heat from the oxidizing zone into the reducing zone to maintain the temperature in the reducing zone greater than or equal to 900 degrees C to provide a high enough temperature to effect the pyrolyzation of step (b), generated $CO_2$ and $H_2O$ and other gases passing upwardly with the circulating particles into the reducing zone from the oxidizing zone to heat the reducing zone; and (f) separating inert particles which pass out of the gas discharge opening with the gas from the gas, and returning the separated inert particles to the oxidizing zone.

2. A method as recited in claim 1 wherein step steps (a)–(f) are practiced so as to maintain 500–1000 g/mol solid particulate material in the gas within the reactor.

3. A method as recited in claim 1 wherein step (e) is practiced in part by circulating sand within the size range of greater than 10 and less than 400 microns.

4. A method as recited in claim 1 wherein steps (a)–(f) are practiced so as to provide a temperature after the reducing zone of 70–120 degrees C lower than the temperature in the oxidizing zone.

5. A method as recited in claim 1 wherein steps (a)–(f) are practiced so that the dwell time of gas in the upper part of the reactor is between 2–20 seconds.

6. A method as recited in claim 1 wherein step (b) is practiced by introducing peat as the carbonaceous fuel.

7. A method as recited in claim 6 wherein step (e) is practiced so as to maintain a solid material circulation flow rate of 7.8 kg/second.

8. A method as recited in claim 1 wherein step (b) is practiced to introduce the carbonaceous material into the reactor at a position at least three meters above the air distribution plate.

9. A method as recited in claim 1 wherein step (b) is practiced so as to introduce the carbonaceous mate rial into the reactor at a position 4–6 meters above the air distribution plate.

10. A method of gasifying solid carbonaceous material in a fluidized bed reactor having upper and lower parts and in which solid particles are separated from the gases flowing out through the upper part of the reactor, and returned to the lower part of the reactor, by introducing oxygen-containing gas into the lower part of the reactor so that an oxidation zone is formed in the lower part, said method comprising the steps of:

(a) introducing the carbonaceous material into a substantially oxygen-free zone above the oxidation zone in the upper part of the reactor so that the carbonaceous material is pyrolyzed in a reducing zone with hot gases and particles rising from the lower part of the reactor;

(b) separating unreacted carbonaceous material from gases flowing out through the upper part of the reactor and returning the unreacted material to the oxidizing zone to be oxidized; and (c) circulating a large flow, compared to the amount of carbonaceous material introduced in step (a), of fine inert material in the reactor, including by separating inert particles flowing with gases out through the upper part of the reactor and returning the separated inert particles to the oxidizing zone, so that the fine inert material is heated in the oxidizing zone and then passes into the reducing zone, transferring the energy required for pyrolysis and reducing reactions from the oxidizing zone to the reducing zone.

11. A method as recited in claim 10 wherein step (a) is practiced by introducing peat as the carbonaceous material.

12. A method as recited in claim 10 wherein steps (a)–(c) are practiced so as to maintain a temperature of between 970–1200 degrees C in the oxidizing zone, and a temperature of greater than or equal to 900 degrees C in the reducing zone.

13. A method as recited in claim 10 wherein steps (a)–(c) are practiced so that the dwell time of gas in the upper part of the reactor is between 2–20 seconds.

* * * * *